US008376691B2

(12) United States Patent
Wulf

(10) Patent No.: US 8,376,691 B2
(45) Date of Patent: Feb. 19, 2013

(54) TURBO ENGINE

(75) Inventor: Joachim Wulf, Munich (DE)

(73) Assignee: MTU Aero Engines GmbH, Munich (DE)

( * ) Notice: Subject to any disclaimer, the term of this patent is extended or adjusted under 35 U.S.C. 154(b) by 786 days.

(21) Appl. No.: 12/523,656

(22) PCT Filed: Jan. 16, 2008

(86) PCT No.: PCT/DE2008/000067

§ 371 (c)(1),
(2), (4) Date: Oct. 26, 2009

(87) PCT Pub. No.: WO2008/086782

PCT Pub. Date: Jul. 24, 2008

(65) Prior Publication Data

US 2010/0054921 A1 Mar. 4, 2010

(30) Foreign Application Priority Data

Jan. 20, 2007 (DE) ..... 10 2007 003 028

(51) Int. Cl.
*F01D 25/26* (2006.01)

(52) U.S. Cl. ..... 415/134; 415/136

(58) Field of Classification Search ..... 415/126, 415/127, 128, 134, 136, 135
See application file for complete search history.

(56) References Cited

U.S. PATENT DOCUMENTS

| | | | | |
|---|---|---|---|---|
| 3,227,418 | A | 1/1966 | West | |
| 4,127,357 | A * | 11/1978 | Patterson | 415/116 |
| 7,396,203 | B2 * | 7/2008 | Martindale | 415/136 |

FOREIGN PATENT DOCUMENTS

| | | | |
|---|---|---|---|
| DE | 10 2004 037 955 | A1 | 3/2006 |
| EP | 1 655 455 | A1 | 5/2006 |

OTHER PUBLICATIONS

PCT/DE2008/000067 PCT/ISA/210; PCT/ISA/220; PCT/ISA/237.
PCT/DE2008/000067 PCT/ISA/206.

* cited by examiner

*Primary Examiner* — Dwayne J White
(74) *Attorney, Agent, or Firm* — Crowell & Moring LLP

(57) ABSTRACT

A turbine engine is disclosed. A blade ring is surrounded by a housing wall, the housing wall being configured as an outer ring, and delimits therewith a gap, the gap being adjustable by deformation of the outer ring. The outer ring is concentrically surrounded by an adjusting element, opposite faces of the outer ring and the adjusting element having the contour of a truncated cone, and rolling bodies being positioned between the outer ring and the adjusting element, the rolling bodies being put at an oblique angle in relation to the axial direction in the radial direction and in the peripheral direction, making it possible for the adjusting element to be rotated in relation to the outer ring while simultaneously adjusting the gap.

15 Claims, 2 Drawing Sheets

TURBO ENGINE

BACKGROUND AND SUMMARY OF THE INVENTION

This application claims the priority of International Application No. PCT/DE2008/000067, filed Jan. 16, 2008, and German Patent Document No. 10 2007 003 028.4, filed Jan. 20, 2007, the disclosures of which are expressly incorporated by reference herein.

The invention relates to a turbine engine, in particular a gas turbine.

A turbo engine having a stator and a rotor is known from German Patent Document No. DE 10 2004 037 955 A1, wherein the rotor has rotor blades and the stator has a housing and guide vanes. The rotor blades at the rotor side form at least one blade ring, which adjoins, on a radially outer end, a radially inner housing wall of the housing, is surrounded by the housing wall and delimits therewith a radial gap. The radially inner housing wall of the housing is designated as the outer ring and serves in particular as a substrate for an intake coating. Furthermore, it is known from DE 10 2004 037 955 A1 that the gap between the outer ring of the housing and the radially outer end of the or each blade ring can be set or adjusted in terms of its clearance via adjusting elements to provide so-called Active Clearance Control, in order to thereby influence the gap and guarantee an optimal gap position in all operating conditions. To do so, according DE 10 2004 037 955 A1, the radially inner housing wall or the outer ring is segmented in the peripheral direction, whereby a separate adjusting element is preferably assigned to every segment. The adjusting elements are preferably designed as electromechanical actuators. The arrangement of the electromechanical actuators, which act on the segments of the radially inner housing wall or the outer ring, occupies relatively a lot of construction space, thereby increasing the overall dimensions of the turbo engine.

Starting herefrom, the present invention is based on the objective of creating a novel turbo engine with Active Clearance Control, which features smaller dimensions.

According to this, the outer ring is concentrically surrounded by an adjusting element that is configured as a union ring, wherein opposite faces of the outer ring and the adjusting element have the contour of a truncated cone, and wherein cylindrical rolling bodies are positioned between the outer ring and the adjusting element, the rolling bodies being put at an oblique angle in relation to the axial direction in the radial direction and in the peripheral direction, thereby making it possible for the adjusting element to be rotated in relation to the outer ring while simultaneously adjusting the gap.

According to a second aspect of the invention, the outer ring is concentrically surrounded by an adjusting element that is configured as a union ring, wherein opposite faces of the outer ring and the adjusting element have a cylindrical contour, and wherein clamp-body-like, non-cylindrical rolling bodies are positioned between the outer ring and the adjusting element, the rolling bodies having a deviating radial extension depending upon their rotational position, thereby making it possible for the adjusting element to be rotated in relation to the outer ring while simultaneously adjusting the gap.

According to a third aspect of the invention, the outer ring is concentrically surrounded by an adjusting element that is configured as a union ring, wherein opposite faces of the outer ring and the adjusting element are contoured such that one of the faces has a cylindrical contour and the other of the faces has a ramp-like contour, and wherein cylindrical rolling bodies are positioned between the outer ring and the adjusting element, thereby making it possible for the adjusting element to be rotated in relation to the outer ring while simultaneously adjusting the gap.

The inventive concepts of Active Clearance Control on a turbo engine make do with relatively little construction space so that the overall dimension of a turbo engine only increases negligibly. In addition, because of the relatively simple structural design, the turbo engine is also not susceptible to wear. Furthermore, only a small amount of adjusting force is required to rotate the ring-like adjusting element in relation to the outer ring to adjust the gap. A further advantage is that the involved components are predominantly stressed by tension and pressure, but are not subject to any, or to only slight, bending stress.

Preferred further developments of the invention are disclosed in the following specification. Without being limited hereto, exemplary embodiments of the invention are explained in greater detail on the basis of the drawings.

DETAILED DESCRIPTION OF THE DRAWINGS

The present invention relates to a turbo engine, in particular a gas turbine, such as, for example, a gas turbine aircraft engine. These types of turbo engines have at least one compressor, at least one combustion chamber as well as at least one turbine, wherein a stator as well as a rotor are present in both the area of the or each compressor as well as in the area of the or each turbine.

The rotor of a compressor or a turbine is comprised of several rotating rotor blades. The stator of a compressor or a turbine is comprised of a housing as well as several stationary guide vanes. The rotor blades assigned to the rotor rotate in relation to the stationary housing and the stationary guide vanes of the stator, wherein the guide vanes form guide blade rings and the rotor blades form blade rings. In this case, one blade ring is respectively positioned between two guide blade rings arranged one after the other in the direction of flow.

A gap is configured both in the area of the or each compressor as well as in the area of the or each turbine of a turbo engine between a radially outer end of a blade ring and a radially inner housing wall of the housing, which is designated as the outer ring. The gap must be as small as possible to optimize the efficiency of the turbo engine.

The present invention relates to those details of a turbo engine, with whose assistance the gap between the radially outer end of a blade ring and the radially inner housing wall or the outer ring of a housing can be automatically influenced or modified in the sense of an Active Clearance Control.

At this point it must be noted that the invention is preferably used in the areas of a compressor of a turbo engine. However, the invention is not restricted to use in the area of the compressor, in fact the invention may also be used in the area of a turbine of a turbo engine.

Figure 1:
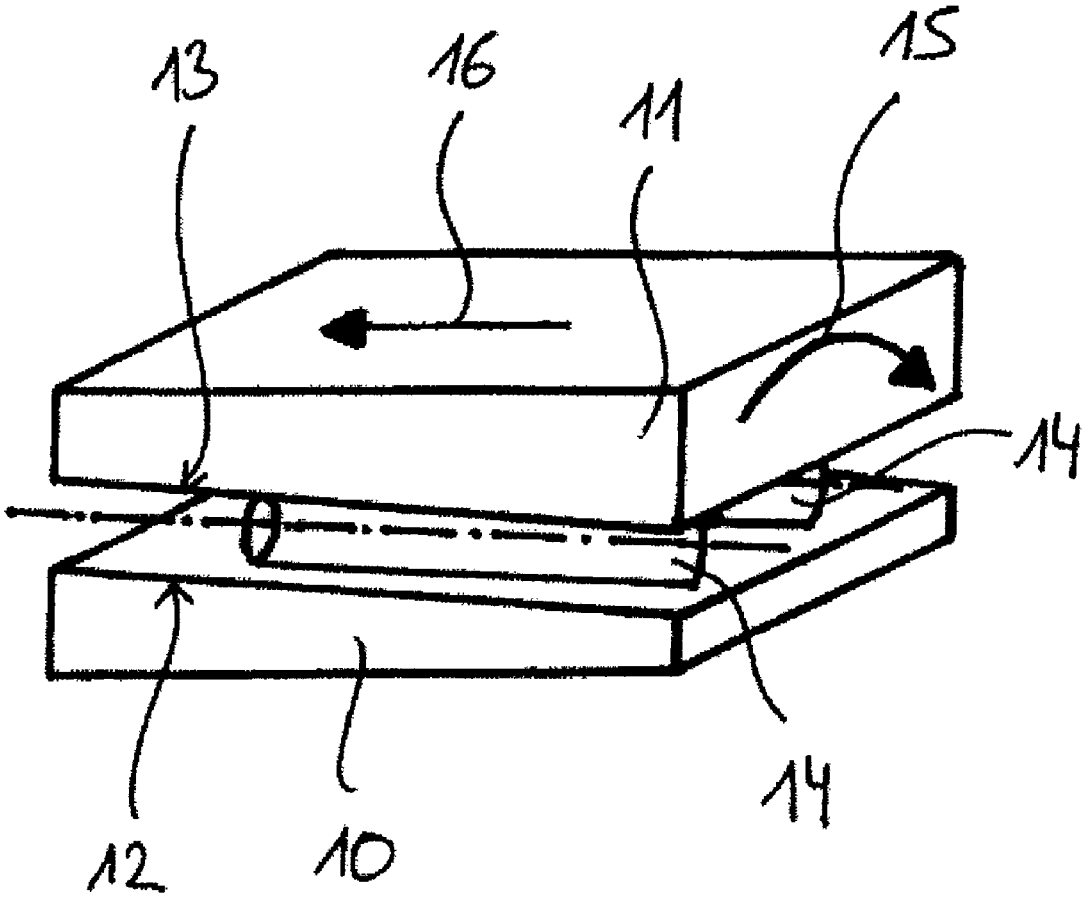
FIG. 1 is a greatly schematized detail of an inventive turbo engine according to a first aspect of the present invention.

FIG. 1 shows a very schematized section of an inventive turbo engine according to a first aspect of the present invention.

Thus, FIG. 1 shows a radially inner housing wall or an outer ring 10 of a stator of a compressor of a gas turbine, wherein the outer ring 10 surrounds a blade ring (not shown). Formed between the outer ring 10 and a radially outer end of the blade ring (not shown) is a gap (also not shown).

The outer ring 10 is concentrically surrounded by an adjusting element 11 that is configured as a union ring. According to FIG. 1, opposite faces 12, 13 of the outer ring 10 and the adjusting element 11 have the contour of a truncated cone, wherein rolling bodies 14 that are configured cylindrically are arranged between the opposite faces 12 and 13 of the outer ring 10 and the adjusting element 11 and thus between the outer ring 10 and the adjusting element 11, which rolling bodies are put at an oblique angle in to relation to the axial direction of the outer ring 10 in the radial direction and in the peripheral direction.

Because rolling bodies 14 are arranged between the outer ring 10 and the adjusting element 11, which concentrically surrounds the outer ring 10, the adjusting element 11 can be rotated in relation to the outer ring 10. Since the opposite faces 12 and 13 of the outer ring 10 and the adjusting element 11, having the contour of a truncated cone, and the rolling bodies 14 are put at an oblique angle relative to the axial direction of the outer ring 10, this rotation of the adjusting element 11 relative to the housing wall 10 causes, in the sense of arrow 15 and also in the sense of arrow 16, a translatory displacement of the adjusting element 11 relative to the outer ring 10, thereby making it possible to adjust the diameter of the outer ring 10 and therefore the gap between the outer ring 10 and the blade ring (not shown).

Reference is made to the fact that the rolling bodies 14 are preferably configured as so-called cage-guided rollers.

Starting from an initial setting of the adjusting element 11 relative to the outer ring 10, in a first rotational direction of the ring-like adjusting element 11, the clearance of the gap can be reduced as related to an initial dimension, and in a second rotational direction of the adjusting element 11 the clearance can be increased in relation to the initial dimension.

When rotating the ring-like adjusting element 11 in relation to the outer ring 10, the outer ring 10 is elastically deformed to adjust the clearance.

According to the first aspect of the present invention, a mechanism is provided to adjust the gap between the outer ring 10 and a radially outer end of a blade ring, which is surrounded by the outer ring 10. This mechanism is essentially comprised of two concentric rings, namely a first, which is formed by the outer ring 10, and a second ring, which is formed by the adjusting element 11. Arranged between these two rings, i.e., between the outer ring 10 and the adjusting element 11, are preferably rolling bodies 14 configured as rollers, which allow a rotation of the adjusting element 11 relative to the outer ring 10. These rolling bodies 14 are put at an oblique angle relative to the axial extension of the housing wall 10 and thus relative to the axial extension of the turbo engine in the peripheral direction and in the radial direction, wherein the opposite faces 12, 13 of the outer ring 10 and the adjusting element 11, between which the rolling bodies 14 are arranged, have the contour of a truncated cone.

Through this, the rotation of the adjusting element 11 relative to the outer ring 10 furthermore causes an axial displacement of the adjusting device 11 relative to the outer ring 10. The adjusting element 11 is screwed onto the outer ring 10 so to speak. In this connection, the adjusting element 11, which is configured with a relatively thick wall thickness, deforms the outer ring 10, which is configured with a relatively thin wall thickness, in the sense of an elastic deformation so that, by rotating the adjusting element 11 relative to the outer ring 10, the diameter of the outer ring 10 is adjusted and therefore the gap between the outer ring and the blade ring can be adjusted. It is also possible to fabricate the adjusting element 11 from a stiffer material than the outer ring 10.

Figure 2:
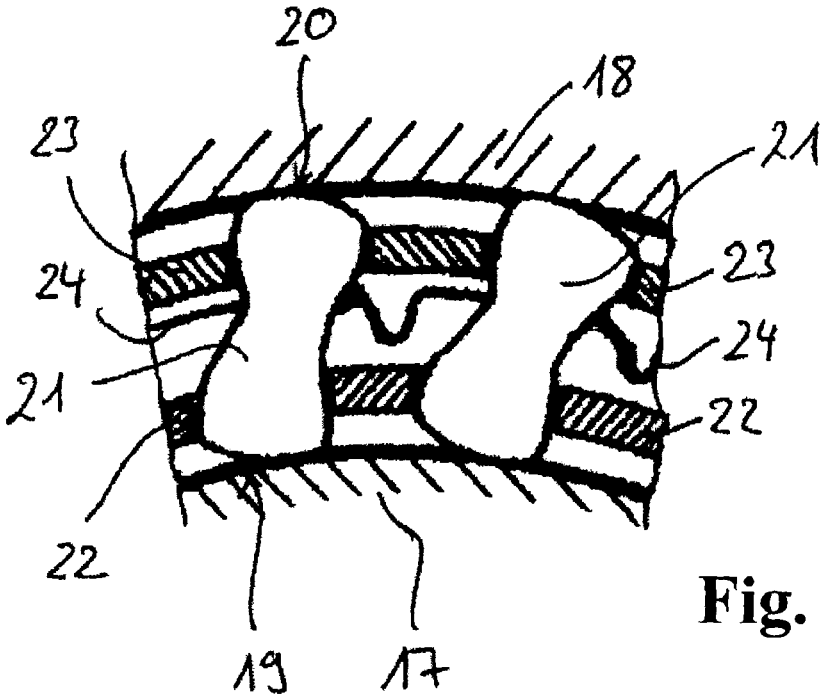
FIG. 2 is a greatly schematized detail of an inventive turbo engine according to a second aspect of the present invention.

FIG. 2 shows a very schematized section of an inventive turbo engine according to a second aspect of the present invention. Thus, FIG. 2 again shows a radially inner housing wall or an outer ring 17 of a stator of a compressor of a gas turbine, wherein the outer ring 17 surrounds a blade ring (not shown). A gap (not shown) is again formed between the outer ring 17 and the radially outer end of the blade ring (not shown).

The outer ring 17 is concentrically surrounded by an element 18 that is configured as a union ring. According to FIG. 2, opposite faces 19 and 20 of the outer ring 17 and the adjusting element 18 have a cylindrical contour, wherein non-cylindrical, clamp-body-like rolling bodies 21 are arranged between the opposite faces 19, 20. The clamp-body-like rolling bodies 21 are guided in cages 22, 23 under prestress via a spring element 24.

The adjusting element 18 can be rotated in relation to the outer ring 17, wherein, when rotating the adjusting element 18 in relation to the outer ring 17, the rolling bodies 21 are also rotated, wherein the rolling bodies 21 have a different radial extension depending upon their rotational position. If the radial extension of the rolling bodies 21 increases due to the rotation of the adjusting element 18, then the outer ring 17 is deformed with the decrease in the gap between the outer ring 17 and the radially outer ends of the rotor blades (not shown). To increase this gap, the adjusting element 18 is rotated in relation to the outer ring 17 such that the radial extension of the rolling bodies 21 is reduced as a result of this rotation.

Figure 3:
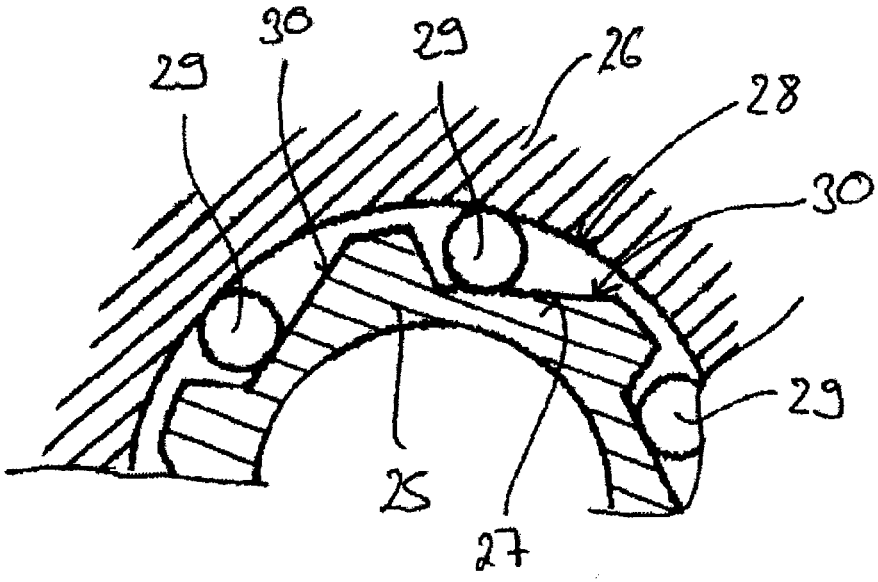
FIG. 3 is a greatly schematized detail of an inventive turbo engine according to a third aspect of the present invention.

FIG. 3 shows a schematic section of an inventive turbo engine according to a third aspect of the present invention, wherein FIG. 3 also shows an outer ring 25 of a stator of a compressor of a gas turbine, which surrounds a blade ring (not shown) and also delimits a gap (not shown) with the blade ring (not shown). In the exemplary embodiment in FIG. 3, the outer ring 25 is also concentrically surrounded by an adjusting element 26 that is configured as a union ring. Opposite faces 27 and 28 of the outer ring 27 and the adjusting element 26 are contoured in the exemplary embodiment in FIG. 3 such that the face 28 of the adjusting element 26 has a cylindrical contour and the face 27 of the outer ring 25 has a ramp-like contour. Thus, several ramps 30 are configured on the surface 27 of the outer ring 25, on which cylindrical rolling bodies 29 positioned between the opposite faces 27 and 28 of the outer ring 25 and the adjusting element 26 roll. In contrast to the exemplary embodiment in FIG. 3, the face 27 of the outer ring 25 may also have a cylindrical contour and the face 28 of the adjusting element 26 may have a ramp-like contour.

When rotating the adjusting element 26 relative to the outer ring 25, the rolling bodies 29 roll off on the ramps 30 configured in the area of the face 27, wherein at the same time the outer ring 27 and thus the gap between the outer ring 27 and the blade ring (not shown) changes and therefore can be adjusted.

In a first rotational direction of the adjusting element 26, the gap is reduced as related to an initial dimension, in a second rotational direction of the adjusting element 26 the clearance of the gap can be increased in relation to the initial dimension.

Like the exemplary embodiment in FIG. 1, in the exemplary embodiments in FIGS. 2 and 3 the adjusting element 18 or 26 is configured with a relatively thick wall thickness and the outer ring 17 or 25 with a relatively thin wall thickness. The outer ring 17 or 25 is subject to an elastic deformation as a consequence of the rotation of the adjusting device 18 or 26. It is again likewise possible to fabricate the adjusting element 18 or 26 from a stiffer material than the outer ring 17 or 25.

The inventive mechanism for providing Active Clearance Control on a turbo engine is characterized by a compact structure with a low construction height. Only a small amount of adjusting force and no holding force is required. Components are predominantly stressed by tension and pressure, but are not subject to any, or to only slight, bending stress.

The invention claimed is:

1. A turbo engine, especially a gas turbine, comprising a stator and a rotor, the rotor having rotor blades and the stator having a housing and guide vanes, the rotor blades at a rotor side forming a blade ring which adjoins on a radially outer end thereof a radially inner housing wall of the housing, the housing wall being configured as an outer ring, the blade ring being surrounded by the housing wall and delimiting therewith a gap, the gap between the outer ring of the housing and the radially outer end of the blade ring being adjustable by a deformation of the outer ring, wherein:

the outer ring is concentrically surrounded by an adjusting element that is configured as a union ring, wherein opposite faces of the outer ring and the adjusting element having a contour of a truncated cone, wherein cylindrical rolling bodies are positioned between the outer ring and the adjusting element at an oblique angle in relation to an axial direction in a radial direction and in a peripheral direction, and wherein when the adjusting element is rotated in relation to the outer ring the gap is simultaneously adjusted.

2. The turbo engine according to claim 1, wherein when the adjusting element is rotated in relation to the outer ring, the adjusting element is adjusted in relation to the outer ring in the axial direction while simultaneously elastically deforming the outer ring to adjust the gap.

3. The turbo engine according to claim 1, wherein in a first rotational direction of the adjusting element a clearance of the gap is reducible in relation to an initial dimension defined by an initial setting of the adjusting element, and wherein in a second rotational direction of the adjusting element the clearance of the gap is increasable in relation to the initial dimension defined by the initial setting of the adjusting element.

4. The turbo engine according to claim 1, wherein a wall of the adjusting element is thicker than a wall of the outer ring.

5. The turbo engine according to claim 1, wherein the adjusting element is fabricated from a stiffer material than the outer ring.

6. A turbo engine, especially a gas turbine, comprising a stator and a rotor, the rotor having rotor blades and the stator having a housing and guide vanes, the rotor blades at a rotor side forming a blade ring which adjoins on a radially outer end thereof a radially inner housing wall of the housing, the housing wall being configured as an outer ring, the blade ring being surrounded by the housing wall and delimiting therewith a gap, the gap between the outer ring of the housing and the radially outer end of the blade ring being adjustable by a deformation of the outer ring, wherein:

the outer ring is concentrically surrounded by an adjusting element that is configured as a union ring, wherein opposite faces of the outer ring and the adjusting element having a cylindrical contour, wherein clamp-body-like, non-cylindrical rolling bodies are positioned between the outer ring and the adjusting element and have a deviating radial extension depending upon a rotational position of the rolling bodies, and wherein when the adjusting element is rotated in relation to the outer ring the gap is simultaneously adjusted.

7. The turbo engine according to claim 6, wherein when the adjusting element is rotated in relation to the outer ring, the clamp-body-like rolling bodies are rotated such that the radial extension of the rolling bodies is changed while simultaneously elastically deforming the outer ring to adjust the gap.

8. The turbo engine according to claim 6, wherein a wall of the adjusting element is thicker than a wall of the outer ring.

9. The turbo engine according to claim 6, wherein the adjusting element is fabricated from a stiffer material than the outer ring.

10. The turbo engine according to claim 6, wherein in a first rotational direction of the adjusting element a clearance of the gap is reducible in relation to an initial dimension defined by an initial setting of the adjusting element, and wherein in a second rotational direction of the adjusting element the clearance of the gap is increasable in relation to the initial dimension defined by the initial setting of the adjusting element.

11. A turbo engine, especially a gas turbine, comprising a stator and a rotor, the rotor having rotor blades and the stator having a housing and guide vanes, the rotor blades at a rotor side forming a blade ring which adjoins on a radially outer end thereof a radially inner housing wall of the housing, the housing wall being configured as an outer ring, the blade ring being surrounded by the housing wall and delimiting therewith a gap, the gap between the outer ring of the housing and the radially outer end of the blade ring being adjustable by a deformation of the outer ring, wherein:

the outer ring is concentrically surrounded by an adjusting element that is configured as a union ring, wherein opposite faces of the outer ring and the adjusting element are contoured such that one of the faces has a cylindrical contour and the other of the faces has a ramp-like contour, wherein cylindrical rolling bodies are positioned between the outer ring and the adjusting element, and wherein when the adjusting element is rotated in relation to the outer ring the gap is simultaneously adjusted.

12. The turbo engine according to claim 11, wherein when the adjusting element is rotated in relation to the outer ring, the rolling bodies roll off and on ramps of the face having the ramp-like contour while simultaneously deforming the outer ring to adjust the gap.

13. The turbo engine according to claim 11, wherein a wall of the adjusting element is thicker than a wall of the outer ring.

14. The turbo engine according to claim 11, wherein the adjusting element is fabricated from a stiffer material than the outer ring.

15. The turbo engine according to claim 11, wherein in a first rotational direction of the adjusting element a clearance of the gap is reducible in relation to an initial dimension defined by an initial setting of the adjusting element, and wherein in a second rotational direction of the adjusting element the clearance of the gap is increasable in relation to the initial dimension defined by the initial setting of the adjusting element.

* * * * *